US006213818B1

(12) United States Patent
Chadbourne

(10) Patent No.: US 6,213,818 B1
(45) Date of Patent: Apr. 10, 2001

(54) ELECTRICAL TERMINAL WITH MULTI-DIRECTIONAL INSTALLATION AND SELF-TIGHTENING LATCH MECHANISM

(75) Inventor: Christopher G. Chadbourne, Nashua, NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/422,589

(22) Filed: Oct. 21, 1999

(51) Int. Cl.[7] ..... H01R 4/36; H01R 27/00; H01R 11/03; H01R 11/09

(52) U.S. Cl. ..... 439/810; 439/812; 439/224; 439/792; 439/784

(58) Field of Search ..... 439/810, 811, 439/812, 813, 814, 224, 217, 784, 790, 791, 792

(56) References Cited

U.S. PATENT DOCUMENTS

| | | | | |
|---|---|---|---|---|
| 970,087 | * | 9/1910 | Murray . | |
| 2,193,202 | * | 3/1940 | Millermaster | 173/269 |
| 2,920,305 | | 1/1960 | Gibson et al. | 339/272 |
| 3,374,456 | | 3/1968 | Evans | 339/32 |
| 3,727,171 | | 4/1973 | Coles et al. | 339/22 B |
| 4,085,989 | | 4/1978 | McCardell | 339/59 |
| 4,214,806 | | 7/1980 | Kraft | 339/242 |
| 4,946,405 | | 8/1990 | Boehm | 439/387 |
| 5,030,131 | | 7/1991 | Boehm | 439/387 |
| 5,117,211 | | 5/1992 | Morgan et al. | 335/202 |
| 5,197,907 | | 3/1993 | Hurtgen | 439/810 |
| 5,203,716 | * | 4/1993 | Martucci et al. | 439/411 |
| 5,269,710 | | 12/1993 | Donnerstag | 439/810 |
| 5,978,208 | * | 11/1999 | Helms et al. | 361/634 |
| 6,040,525 | * | 3/2000 | Chauquet et al. | 174/40 CC |

* cited by examiner

*Primary Examiner*—Renee Luebke
*Assistant Examiner*—Edwin A. León
(74) *Attorney, Agent, or Firm*—Perman & Green, LLP

(57) ABSTRACT

An electrical connector is provided comprising a frame and at least one set screw. The frame comprises a connector head having multiple intersecting conductor receiving passageways capable of receiving an electrical conductor in one of a plurality of directions. The at least one set screw is connected to the connector head to intersect the conductor receiving passageways. The frame is formed from a single piece of flat conductive material.

18 Claims, 3 Drawing Sheets

ELECTRICAL TERMINAL WITH MULTI-DIRECTIONAL INSTALLATION AND SELF-TIGHTENING LATCH MECHANISM

BACKGROUND OF THE INVENTION

1. Field of the Invention

The present invention relates to electrical connectors and, more particularly, to set screw electrical connectors.

2. Prior Art

Set screw electrical connectors are generally well known in the art. One example is found in U.S. Pat. No. 2,920,305, which shows an electrical terminal connector employing a set screw to secure a conductor.

SUMMARY OF THE INVENTION

In accordance with one embodiment of the present invention, an electrical connector is provided comprising a frame and at least one set screw. The frame comprises a connector head having multiple intersecting conductor receiving passageways capable of receiving an electrical conductor in one of a plurality of directions. The at least one set screw is connected to the connector head to intersect the conductor receiving passageways. The frame is formed from a single piece of conductive material.

In accordance with another embodiment of the present invention, an electrical connector is provided comprising a frame and a set screw. The frame comprises a block section and a tongue section formed from a single piece of conductive material. The block section comprises receiving passageways with a recessed area in each of the passageways. The set screw is connected to the frame. When a conductor is received in one of the conductor receiving passageways, a portion of the conductor can be clamped between the set screw and the frame along a surface of one of the recessed areas.

In accordance with another embodiment of the present invention, an electrical connector frame is provided comprising a head section and a tongue section. The head section has at least one tab on an end of the head section. The tongue section is connected to the head section. The tongue section contains at least one notched area. The tab interconnects with the notched area to form a latch. The head section and the tongue section are formed from a single piece of flat conductive material.

In accordance with one method of the present invention, a method for manufacturing an electrical terminal connector is provided comprising steps of providing a single piece of conductive material; and forming the piece of conductive material to form a latching system and conductor receiving passageways with recessed areas.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
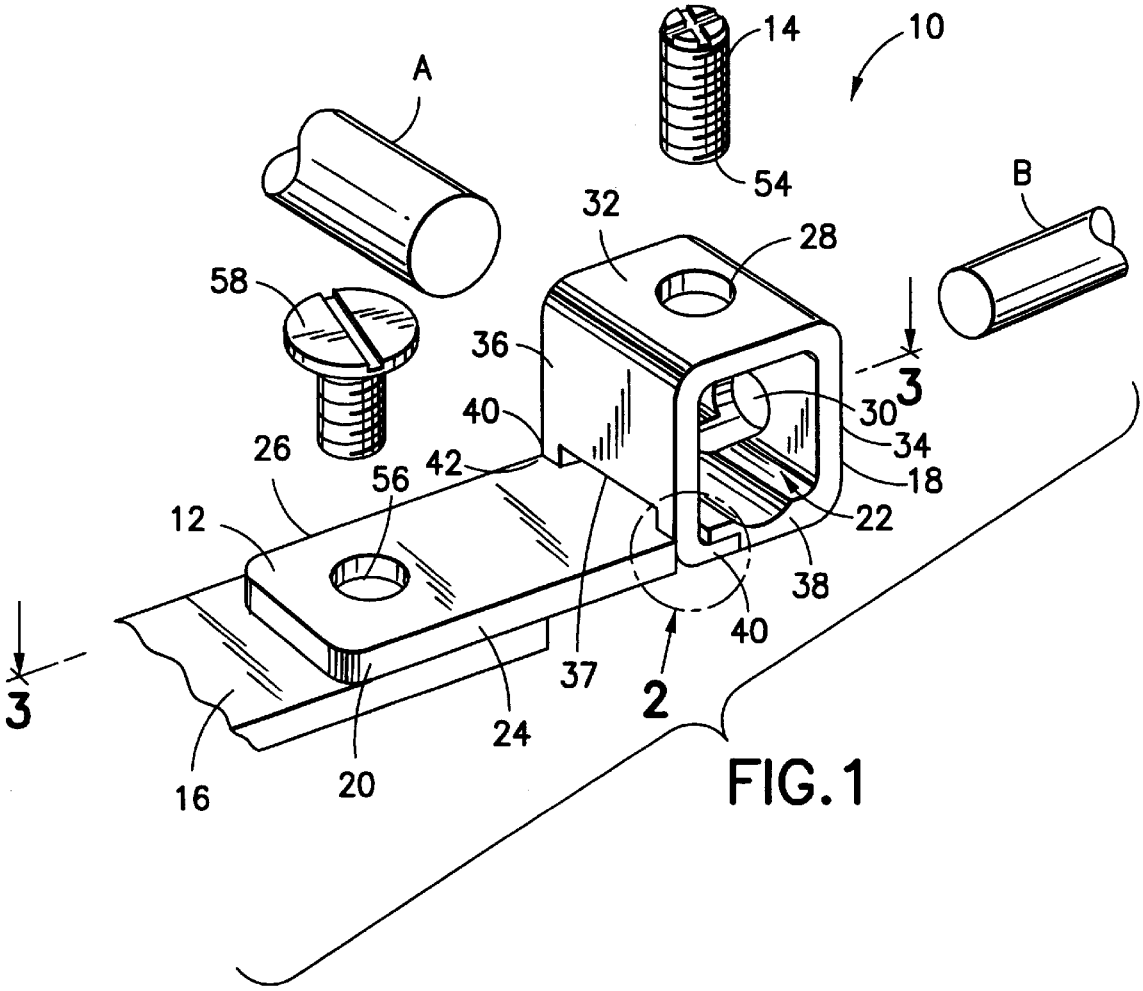
FIG. 1 shows an exploded perspective view of an electrical terminal connector incorporating features of the present invention.

Referring to FIG. 1, there is shown an exploded perspective view of an electrical connector 10 incorporating features of the present invention. Although the present invention will be described with reference to the embodiment shown in the drawings, it should be understood that the present invention could be embodied in various different types of electrical connectors. In addition, any suitable size, shape or type of elements or materials could be used.

The connector 10 generally comprises a frame 12 and a fastener 14. The connector 10 is generally intended to mechanically and electrically connect an electrical conductor A or B to another member 16. The frame 12 generally comprises a head section 18 and a tongue section 20. However, in alternate embodiments the frame could comprise additional components or sections. In a preferred embodiment the frame 12 comprises a single one-piece member, such as a sheet metal member which has been stamped and formed into the shape shown. The sheet metal member is preferably flat, but can be stamped or coined as described below with reference to FIG. 5. The frame could also be formed from a rod or tube which is flattened during manufacturing, such as based upon materials requirements. Thus, the term "flat" is intended to include a tube or rod which has been substantially flattened.

The head section 18 generally comprises a loop or ring shape. However, other shapes could be provided. The ring shape provides a first conductor receiving passageway 22 extending between lateral sides 24, 26 of the frame 12. In alternate embodiments the frame 12 could be bent or formed to provide multiple parallel conductor receiving passageways between the lateral sides 24, 26 or any other suitable passage(s). The head section 18 also comprises two apertures 28, 30 extending through the frame into the first passageway 22. The first aperture 28 is preferably threaded to interact with the fastener 14. The first aperture 28 extends through a top wall 32 of the head section 18. The second aperture 30 extends through an end wall 34 of the head section 18. In this embodiment the opposite end wall 36 is connected to the bottom wall 38.

Figure 2:
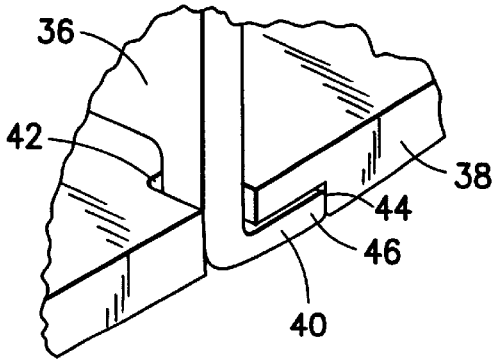
FIG. 2 is an enlarged view of area 2 shown in FIG. 1.

Referring also to FIG. 2, the end wall 36 includes two legs 40. The bottom wall 38 includes two apertures or slots 42. In this embodiment the slots 42 extend into the lateral sides 24, 26. In alternate embodiments the slots could be spaced from the sides 24, 26. In addition more or less than two slots and two legs could be provided. They also could have any suitable shape. In this embodiment the slots 42 also include a recess 44. A portion 46 of each leg 40 is bent or latches into its respective recess 44 to thereby interlock the legs 40 with the bottom wall 38. In alternate embodiments other suitable types of interlocking shapes or configurations could be used to interlock the two walls 36, 38 to each other.

Figure 3:
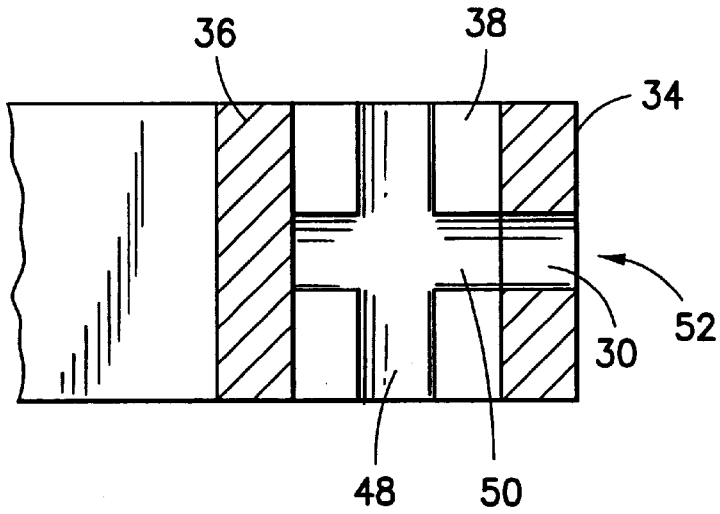
FIG. 3 is a cross-sectional view along line 3—3 of the frame shown in FIG. 1.

Referring also to FIG. 3, the interior side of the bottom wall 38 comprises two concave groove sections 48, 50. A first one of the concave groove sections 48 extends between the sides 24, 26 generally along and parallel with the first passage 22. The second concave groove section 50 extends from the hole 30 generally perpendicular to the passage 22. The hole 30, groove section 50 and a part of the passage 22 form a second conductor receiving passage 52 generally perpendicular to the first passage 22. Thus, the head section 18 can receive the conductor A in the first passage 22 or alternatively receive the conductor B in the second passage 52. In this embodiment the two groove sections 48, 50 intersect each other at a right angle. However, in alternate embodiments any suitable angle of intersection could be provided.

The groove sections 48, 50 generally provide the function of assisting in locating the conductors A or B directly under the hole 28. Thus, when the fastener 14 is screwed into the hold 28 and its tip 54 presses down against the conductor, there is less likelihood that the conductor will slip out from underneath the tip 54. In the embodiment shown the fastener 14 is a set screw. However, in alternate embodiments any suitable type of fastener could be used. The connector could also include multiple fasteners for connecting multiple conductors to the frame. When the fastener 14 tightens down on the conductor A or B and pushes the conductor against the bottom wall 38, forces are exerted against the top wall 32 by the fastener 14 to attempt to move the top wall away from the bottom wall 38. The interlocking connection of the legs 40 at end 37 of the wall 36 prevents the wall 36 from pulling away from the wall 38.

The tongue section 20 extends from the head section 18. The tongue section 20 could have any suitable shape or size. In this embodiment the tongue section 20 includes a hole 56. The hole 56 is provided such that a fastener 58 can pass through the hole 56 and attach to the member 16 to thereby electrically and mechanically attach the tongue section 20 to the member 16. However, in alternate embodiments any suitable connection system could be used to connect the tongue section to another member.

The present invention, unlike connectors such as disclosed in U.S. Pat. Nos. 4,946,405 and 2,920,305, allows the frame to be formed from sheet metal that is stamped and formed rather than being cast. Thus, the connector according to the present invention can be less expensive to manufacture, faster to manufacture, and lighter in weight. The present invention, unlike connectors such as disclosed in U.S. Pat. No. 5,197,907, can also allow the frame to accept a conductor in multiple different directions or position. Thus, the present invention can be used to provide a multi-axis conductor receiving connector with a frame formed from stamped and formed sheet metal providing combined advantages not heretofore available.

Figure 4:
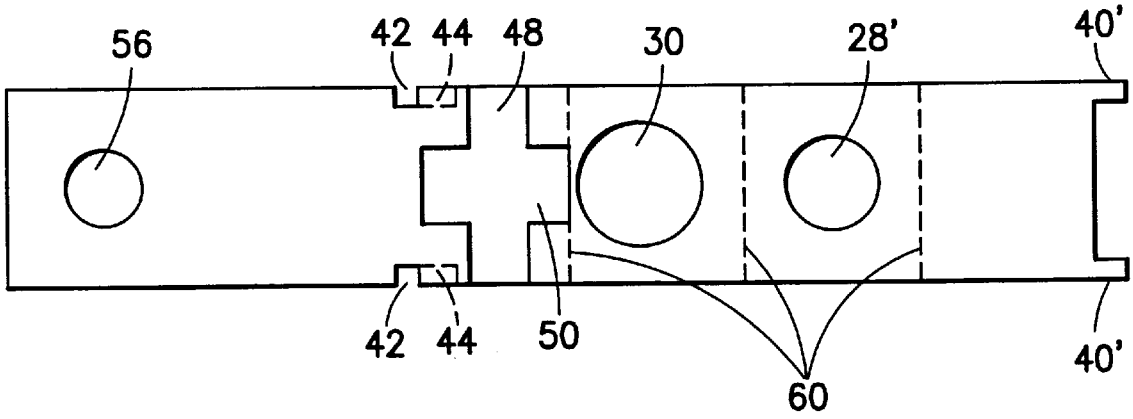
FIG. 4 is a top plane view of a blank used to form the frame shown in FIG. 1.

Referring also to FIG. 4, a flat sheet metal blank 12' is shown which is used to form the frame 12. The blank 12' is preferably stamped from sheet metal. However, in alternate embodiments other suitable forming techniques or materials could be used. The sheet metal is stamped to form the holes 28', 30, 56, holes 42 and legs 40'. The hole 28' can then be threaded to form the hole 28. The recesses 44 can be formed. However, it is not necessary to provide the frame with the recesses 44. The concave grooved sections 48, 50 can be formed before or after the flat blank 12' is bent. The flat blank 12' is bent in three locations 60; 90° at each location 60. However, more or less bend locations could be provided and, at any suitable angles, such as for triangular or other polygonal shapes. When the legs 40' are inserted into the holes 42 the legs 40' can then be bent into recesses 44.

Figure 5:
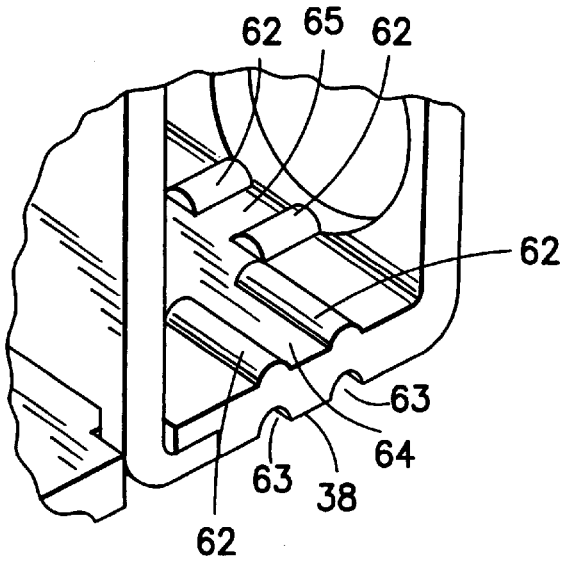
FIG. 5 is a partial perspective view of an alternate embodiment of the present invention.

Referring now to FIG. 5, an alternate embodiment is shown. In this embodiment the bottom wall does not comprise concave groove sections. Instead, the bottom wall 38' comprises raised ridges 62. In this embodiment the ridges 62 are formed by stamping the bottom wall 38' forming recesses 63 on the bottom side of the bottom wall. The ridges could alternatively be formed by coining. However, any suitable method could be used to form the ridges 62. The ridges 62 are arranged as pairs of spaced parallel ridges forming areas 64, 65 therebetween. The areas 64, 65 intersect each other at an angle; in this case a perpendicular angle. The ridges 62 act as guides for the conductors to keep the conductors in the areas 64 or 65 as the fastener 14 is tightened against the conductors. In other alternate embodiments, any suitable type of conductor guide or position holder could be provided on the bottom wall.

Figure 6:
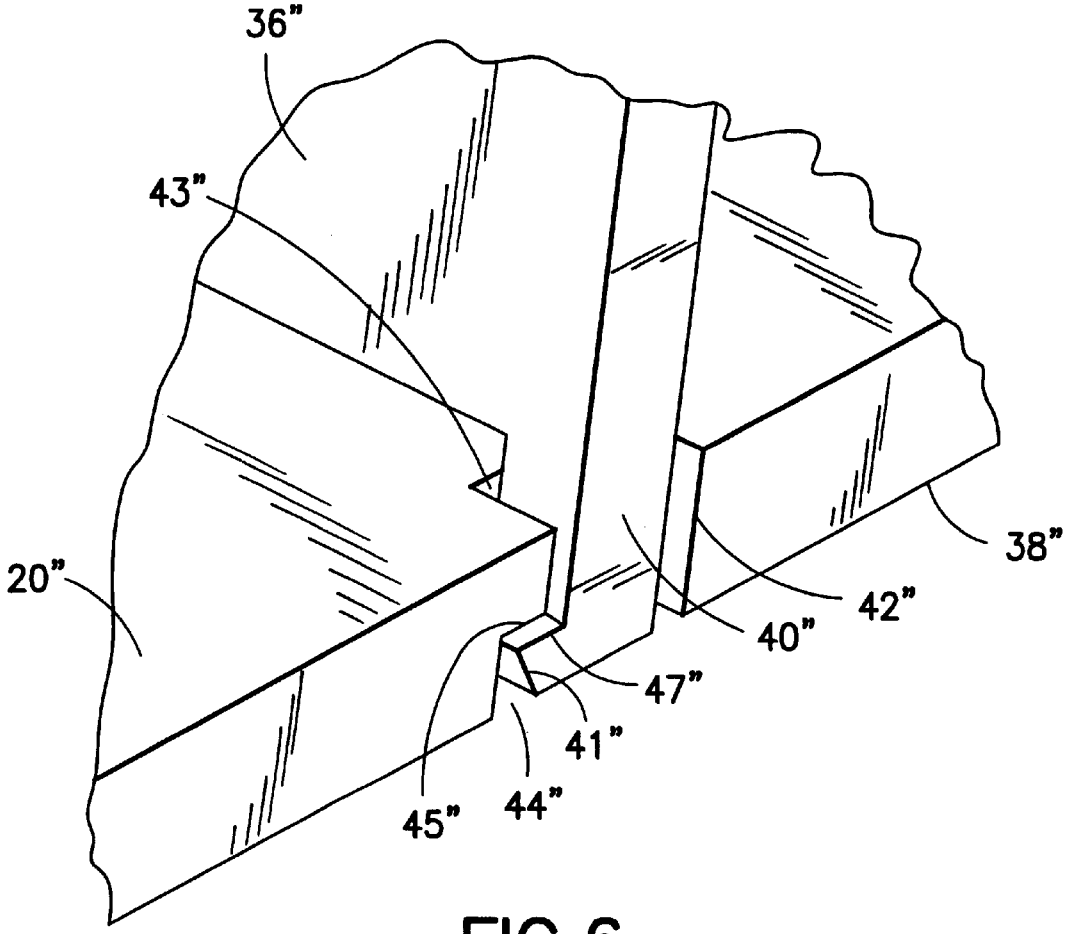
FIG. 6 is a partial perspective view of another alternate embodiment of the present invention.

Referring now to FIG. 6, another alternate embodiment will be described. In this embodiment the wall 36" has a leg 40" formed as a snap-lock latch. The bottom wall 38" or tongue section 20" has an aperture 42" which forms a snap-lock receiving aperture. The aperture 42" has a through-hole section 43" and a recess section 44" with a latch surface 45". The leg 40" has a latch surface 47" and an angled surface 41". Thus, the leg 40" can be completely formed before it is inserted into the aperture 42" and subsequently snap-lock mounted through the aperture 42".

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a frame comprising a connector head having multiple intersecting conductor receiving passageways capable of receiving an electrical conductor in one of a plurality of directions; and at least one set screw connected to the connector head to intersect the conductor receiving passageways;

wherein the frame is formed from a single piece of flat conductive material, wherein a section of the single piece of flat conductive material is bent to form a first one of the receiving passageways, and wherein a hole is formed through the bent section of the single piece of flat conductive material which forms a second one of the receiving passageways into the first receiving passageway.

2. A connector as in claim 1 wherein an end of the single piece of flat conductive material has a portion which is bent into a leg that latches beneath another portion of the frame.

3. A connector as in claim 1 wherein the frame further comprises a tongue section extending from the head.

4. A connector as in claim 3 wherein the tongue section comprises a hole therethrough for a fastener to extend through the hole.

5. A connector as in claim 3 wherein the tongue section is flat.

6. A connector as in claim 3 wherein the tongue section extends from the head in a general cantilever fashion.

7. A connector as in claim 1 wherein the single piece of flat conductive material comprises an aperture, and wherein a portion of the head extends through the aperture.

8. A connector as in claim 7 wherein a bottom surface of the frame comprises a recess adjacent the aperture, and wherein the portion is deformed into a leg that extends into the recess.

9. A connector as in claim 7 wherein the portion comprises a latch surface.

10. A connector as in claim 9 wherein the portion comprises a snap-lock latch which snap locks into the aperture.

11. A connector as in claim 1 wherein a first concave groove is formed along a surface of the section of the single piece of flat conductive material along the first receiving passageway.

12. A connector as in claim 11 wherein a second concave groove is formed along the surface and intersects the first groove at an angle.

13. A connector as in claim 1 wherein a first pair of raised parallel and spaced ridges is formed along a surface of the section of the single piece of flat conductive material along the first receiving passageway.

14. A connector as in claim 13 wherein a second pair of raised ridges is formed along the surface and intersects the first pair of raised ridges at an angle.

15. An electrical connector comprising:

a frame comprising a block section and a tongue section formed from a single piece of flat conductive material, wherein the block section comprises two receiving passageways substantially normal to one another with a recessed area in each of the passageways, wherein the block section comprises an aperture, and wherein a portion of the block section extends through the aperture; and a set screw connected to the frame for intersecting both of the passageways, wherein, when a conductor is received in one of the conductor receiving passageways, a portion of the conductor can be clamped between the set screw and the frame along a surface of either one of the two recessed areas by the single set screw.

16. An electrical connector frame comprising:

a head section with at least one tab on an end of the head section; and a tongue section connected to the head section, the tongue section containing at least one notched area, wherein the tab interconnects with the notched area to form a latch, and wherein the head section and the tongue section are formed from a single piece of flat conductive material.

17. A method for manufacturing an electrical terminal connector comprising steps of:

providing a single piece of flat conductive material;

forming the piece of flat conductive material to form a latching system and a head having conductor receiving passageways substantially normal to one another with recessed areas, wherein the latching system comprises a first section of the head having a tab, and wherein the tab is inserted into and extends through an aperture of a second section to latch the first and second sections to each other; and connecting a set screw to the head for intersecting the passageways.

18. An electrical connector comprising:

a frame formed from a single piece of flat conductive material, the frame comprising a head section and a tongue section, the head section comprising the single piece of flat conductive material being bent into a general loop shape with at least one open lateral side and forming a conductor receiving passage between the open lateral side and an opposite lateral side, an end portion of the single piece of flat conductive material at the general loop shape being interlocked with another portion of the single piece of flat conductive material, an interior surface of a first wall of the head section having a conductor guide thereon in the receiving passage, and a second wall of the head section having an aperture into the conductor receiving passage; and a set screw extending into the conductor receiving area through a third wall of the head section.

* * * * *